US006163507A

United States Patent [19]

Gholson

[11] Patent Number: 6,163,507

[45] Date of Patent: Dec. 19, 2000

[54] REMOTELY ACTIVATED ALARM CLOCK SYSTEM

[76] Inventor: Gary R Gholson, P.O. Box 313004, Guatay, Calif. 91931

[21] Appl. No.: 09/119,515

[22] Filed: Jul. 20, 1998

[51] Int. Cl.[7] ..... G04B 23/00

[52] U.S. Cl. ..... 368/12; 368/73; 368/248; 368/249; 368/256

[58] Field of Search ..... 368/10, 11, 12, 368/73, 248, 249, 256

[56] References Cited

U.S. PATENT DOCUMENTS

| | | | |
|---|---|---|---|
| 4,316,273 | 2/1982 | Jetter . | |
| 5,189,648 | 2/1993 | Cooper et al. . | |
| 5,311,488 | 5/1994 | Trantham . | |
| 5,359,577 | 10/1994 | Hoshino et al. . | |
| 5,460,347 | 10/1995 | Schacher | 248/316.5 |
| 5,605,235 | 2/1997 | Johnson | 211/13 |
| 5,675,427 | 10/1997 | Miller | 359/142 |
| 5,886,952 | 3/1999 | White | 368/10 |
| 5,926,442 | 7/1999 | Sirhan et al. | 368/73 |
| 5,984,788 | 11/1999 | Lebensfeld et al. | 463/51 |

*Primary Examiner*—Diego Gutierrez
*Assistant Examiner*—Jeanne-Marguerite Goodwin
*Attorney, Agent, or Firm*—Michael I Kroll

[57] ABSTRACT

A remotely activated snooze control circuit for enabling a snooze alarm from a position remote from the snooze control circuit. The remotely activated snooze control circuit includes a remote control unit including an infrared signal generator and a transmitter. An alarm clock is located remotely from the remote control unit and includes an infrared receiver and a control unit connected to the infrared receiver and the snooze control circuit. When the infrared signal is transmitted by the remote control unit and received by the alarm clock, the snooze control circuit is activated to prevent the alarm clock from generating an alarm signal for a predetermined period of time. The remote control unit is preferably in the form of a laser gun and includes a trigger, a speaker and a visual alarm generator. Pressing the trigger initiates activation of the infrared signal and causes the speaker and visual alarm generator to produce audible and visual alarm signals simulating the firing of a laser gun. When the infrared signal is received by the alarm clock a visual alarm is generated and an audible alarm simulating an explosion is generated.

1 Claim, 7 Drawing Sheets

S2
SET ALARM CLOCK ALARM TIME.
S4
TURN ALARM CLOCK ALARM TO ON POSITION.
S6
ALARM CLOCK ALARM GOES OFF.
S8
LIGHT SURROUNDING INFRARED RECEIVER ILLUNINATES.
S10
RETRIEVE LASER GUN.
S12
TURN POWER SWITCH ON LASER GUN TO ON POSITION.
S14
LASER GUN GENERATES AUDIBLE CLICKING SOUND.
S16
POINT LASER GUN AT ALARM CLOCK INFRARED RECEIVER.

REMOTELY ACTIVATED ALARM CLOCK SYSTEM

BACKGROUND OF THE INVENTION

1. Field of the Invention

The present invention relates generally to alarm clocks and, more specifically, to a remotely activated alarm clock system including an alarm clock having a snooze alarm circuit activated upon receipt of an infrared signal transmitted from a remote device, the remote device and alarm clock generating various visible light patterns and audible signals upon transmission and receipt of the infrared signal.

2. Description of the Prior Art

Numerous types of alarm clocks have been provided in the prior art. For example, U.S. Pat. Nos. 4,316,273; 5,189,648; 5,311,488 and 5,359,577 all are illustrative of such prior art. While these units may be suitable for the particular purpose to which they address, they would not be as suitable for the purposes of the present invention as heretofore described.

It is thus desirable to provide an alarm clock including snooze alarm circuit activated by a remotely generated infrared signal which eliminates the need for pressing a button located on the alarm clock to activate the snooze alarm circuit. It is further desirable to provide an alarm clock including snooze alarm circuit activated by a remotely generated infrared signal able to eliminate the need to be adjacent the alarm clock to activate the snooze alarm. It is even further desirable to provide an alarm clock including snooze alarm circuit activated by a remotely generated infrared signal which allows the user to vent an often felt hostility towards an alarm clock in a nonviolent manner. It is still further desirable to provide an alarm clock including snooze alarm circuit activated by a remotely generated infrared signal whereby the nonviolent manner of venting is via a remote control device in the shape of a laser gun emitting the infrared beam from the barrel thereof, the laser gun producing visible and audible signals upon transmission of the infrared signal and causing the alarm clock to also produce such signals upon receipt of the infrared signal.

U.S. Pat. No. 4,316,273

Inventor: Milton W. Jetter

Issued: Apr. 9, 1996

An alarm clock system consisting of a clock with a local alarm circuit and provided with a remotely located turn-off control device actuated by a push button switch. The local alarm system, in response to an electrical signal produced by the clock at a preset time, generates a first sound in the form of a continuous tone lasting for 40 seconds followed by a strident pulsating sound for another 40 seconds. To turn off the alarm, the user must get out of bed, walk to the remote location, and then depress the switch push button and hold it for a predetermined time, such as 12 seconds. Actuation of the push button switch causes the remote control component to generate and transmit a radio signal, which is detected by a radio receiver in the alarm clock local component. Also, an indicating lamp on the remote component is energized and goes off after 12 seconds of continuous depression of the push button. The radio signal received by the local component causes interruption of the alarm and completely deactivates the alarm mode after 12 seconds of push button depression. If the push button is released, namely, before 12 seconds, the transmission of the radio signal stops and the clock alarm resumes. The push button must again be depressed to start another alarm-deactivation period. The system is arranged so that if so desired, a direct connection of the push button switch alarm turn-off component can be made to the clock component, and the radio link is not used. As another alternative, the remote transmitter can be coupled to the clock radio receiver by a coaxial cable.

U.S. Pat. No. 5,189,648

Inventor: Stephen B. Cooper et al.

Issued: Feb. 23, 1993

A game-alarm clock including an electronic clock, an alarm and an electronic game. The electronic game is connected between the electronic clock and the alarm whereby an individual must successfully play the electronic game in order to prevent the alarm from sounding or to turn off the alarm sound off.

U.S. Pat. No. 5,311,488

Inventor: Herbert B. Trantham

Issued: May 10, 1994

An alarm clock is provided which coordinates mechanical motion or action with a distinctive sound, when the alarm clock reaches a set alarm time. The action alarm clock includes an elongated base defining a linear track for movement of an object such as a train engine between end stops when the alarm clock reaches the set alarm time. Such movement is accompanied by an audible sound comprising a novelty sound chosen to correspond with the nature of the moving object. When the moving object reaches a front end stop, the sound is terminated and a regular alarm clock signal is enabled.

U.S. Pat. No. 5,359,577

Inventor: Yukari Hoshino et al.

Issued: Oct. 25, 1994

An alarm clock has an ambient light detector for controlling the illumination of a time displaying section. An alarm time which is selected by a user is stored in a memory. An alarm set switch is used to switch between alarm-on and alarm-off conditions. A photosensor detects the ambient light surrounding the alarm clock. The illumination of the displaying section is controlled so that the displaying section is illuminated only when the current time is within a predetermined time zone before the alarm time set by the user, the alarm set switch is in the alarm-on condition and the detect ambient light is below a predetermined level. The illumination of the displaying section is also controlled so that the display is illuminated while an alarm sound is being generated. The time at which the user switches the alarm set switch to the alarm-on condition can be stored, and the illumination of the displaying section is illuminated after a predetermined amount of time had elapsed after the alarm set switch has been switched to the alarm-on condition.

SUMMARY OF THE PRESENT INVENTION

The present invention relates generally to alarm clocks and, more specifically, to a remotely activated alarm clock system including an alarm clock having a snooze alarm circuit activated upon receipt of an infrared signal transmitted from a remote device, the remote device and alarm clock generating various visible light patterns and audible signals upon transmission and receipt of the infrared signal.

A primary object of the present invention is to provide a remotely activated alarm clock system that will overcome the shortcomings of prior art devices.

Another object of the present invention is to provide a remotely activated alarm clock system which is able to activate a snooze alarm circuit of the alarm clock from a position remotely located from the alarm clock.

A yet further object of the present invention is to provide a remotely activated alarm clock system wherein the remote control unit is in the form of a laser gun.

A further object of the present invention is to provide a remotely activated alarm clock system which is able to produce additional visual and audible effects consistent with the firing of the laser gun when activating the remote control unit to generate and transmit the infrared signal.

A still further object of the present invention is to provide a remotely activated alarm clock system including an additional visual indicator on the alarm clock for providing a visible signal for a predetermined period of time upon receipt of the infrared signal.

A further object of the present invention is to provide a remotely activated alarm clock system wherein the infrared signal is emitted upon activation of a trigger on the laser gun shaped remote control unit.

A still further object of the present invention is to provide a remotely activated alarm clock system including a holster positioned adjacent the user for retaining the laser gun shaped remote control unit therein.

Another object of the present invention is to provide a remotely activated alarm clock system that is simple and easy to use.

A still further object of the present invention is to provide a remotely activated alarm clock system that is economical in cost to manufacture.

Additional objects of the present invention will appear as the description proceeds.

A remotely activated snooze control circuit for enabling a snooze alarm from a position remote from the snooze control circuit. The remotely activated snooze control circuit includes a remote control unit including an infrared signal generator and a transmitter. An alarm clock is located remotely from the remote control unit and includes an infrared receiver and a control unit connected to the infrared receiver and the snooze control circuit. When the infrared signal is transmitted by the remote control unit and received by the alarm clock, the snooze control circuit is activated to prevent the alarm clock from generating an alarm signal for a predetermined period of time. The remote control unit is preferably in the form of a laser gun and includes a trigger, a speaker and a visual alarm generator. Pressing the trigger initiates activation of the infrared signal and causes the speaker and visual alarm generator to produce audible and visual alarm signals simulating the firing of a laser gun. When the infrared signal is received by the alarm clock a visual alarm is generated and an audible alarm simulating an explosion.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
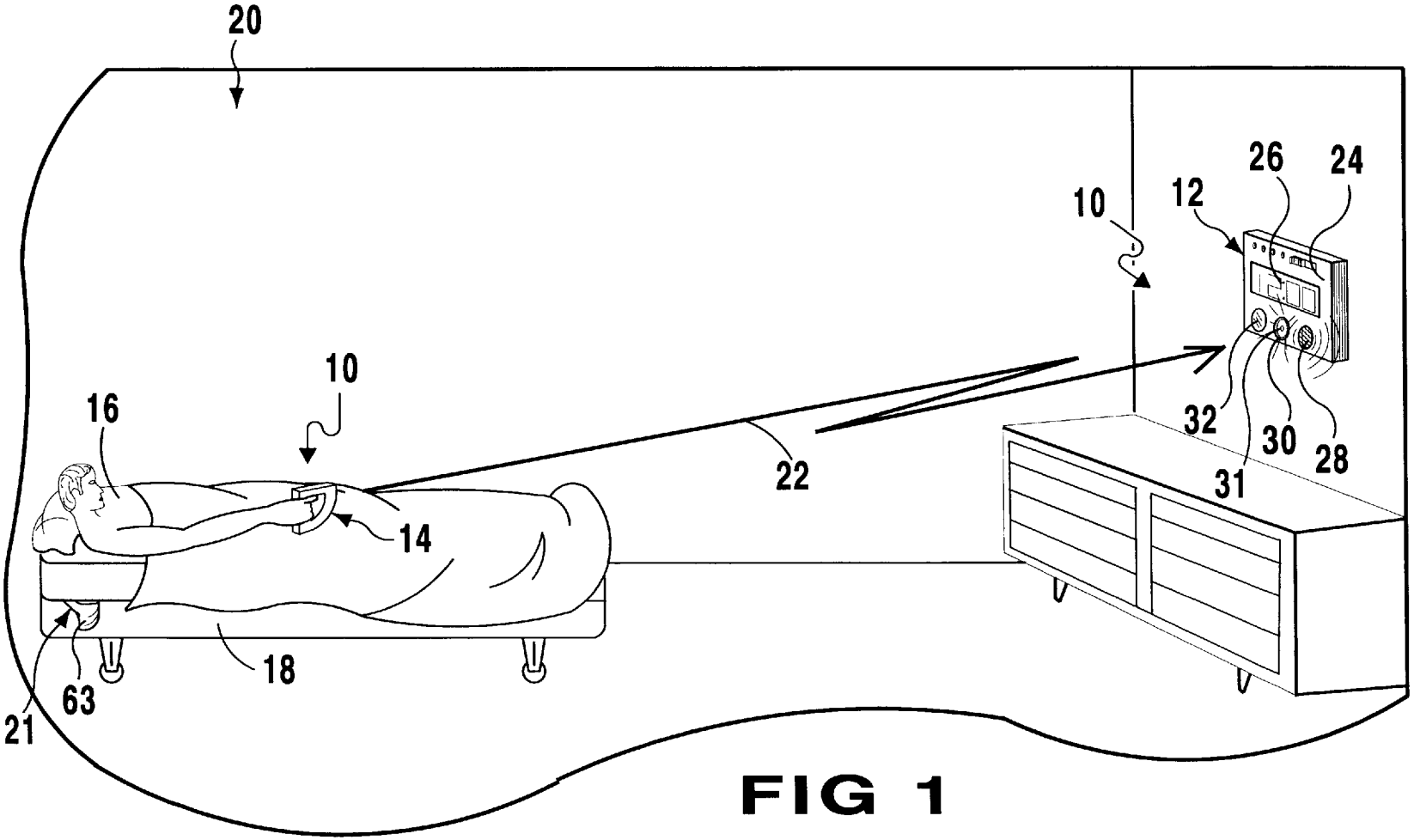
FIG. 1 is a side perspective view of a user utilizing the alarm clock and remote control unit of the remotely activated alarm clock system of the present invention to activate the snooze alarm circuit of the alarm clock.

Turning now descriptively to the drawings, in which similar reference characters denote similar elements throughout the several views, the Figures illustrate the remotely activated alarm clock system of the present invention. With regard to the reference numerals used, the following numbering is used throughout the various drawing figures.

10 remotely activated alarm clock system of the present invention

12 alarm clock

14 remote control unit

16 user

18 bed

20 room

21 holster

22 arrow indicating infrared signal transmitted by remote control unit

24 face side of alarm clock

26 time display on face side of alarm clock

28 speaker

30 infrared receiver

31 light surrounding infrared receiver

32 visual signal

34 hour set button on alarm clock

36 minute set button on alarm clock

38 clock set button on alarm clock

40 alarm time set button on alarm clock

42 alarm switch of alarm clock

44 ON position of alarm clock

46 OFF position of alarm clock

48 trigger/activation button of remote control unit

49 trigger guard
50 barrel of remote control unit
52 handle of remote control unit
54 speaker on remote control unit
56 visual alarm on remote control unit
58 on/off switch
60 infrared transmitter of the remote control unit
61 attachment device
62 control unit of the remote control unit
63 retaining portion
64 power source of the remote control unit
68 control unit of the alarm clock
70 power source of the alarm clock
72 snooze control circuit

DETAILED DESCRIPTION OF THE PREFERRED EMBODIMENT

Turning now descriptively to the drawings, in which similar reference characters denote similar elements throughout the several views, FIGS. 1 through 5 illustrate the remotely activated alarm clock system of the present invention indicated generally by the numeral 10.

The remotely activated alarm clock system 10 is illustrated in FIG. 1 and includes an alarm clock 12 and a remote control unit 14. In this figure the remotely activated alarm clock system 10 is shown being activated by a user 16. The user 16 is lying in bed 18 with the alarm clock 12 positioned across the room 20 from the bed 18. Prior to use the remote control unit 14 is positioned within a holster 21 positioned adjacent to the user 16. In the instance depicted in the drawings the holster 21 is attached to a side of the bed 18. The user 16 is shown holding the remote control unit 14. When the user 16 activates the remote control unit 14, an infrared signal represented by the arrow labeled 22 is generated thereby and transmitted therefrom. The remote control unit 14 is to be directed in the general direction of the alarm clock 12 and thus the infrared signal 22 will be received by an infrared receiver connected to the alarm clock 12.

The alarm clock 12 includes a face side 24 on which a numerical display 26, a speaker 28, an infrared receiver 30, a target light 31 and an alarm light 32 are positioned. The infrared signal 22 is received by the infrared receiver 30 to activate a snooze control circuit which will be discussed in more detail hereinafter. When the alarm clock 12 is triggered to indicate a particular set time, the speaker 28 will produce an audible signal and the alarm light 32 will flash when the infrared signal is received. The light 31 surrounding the infrared receiver 30 will also illuminate.

Figure 2:
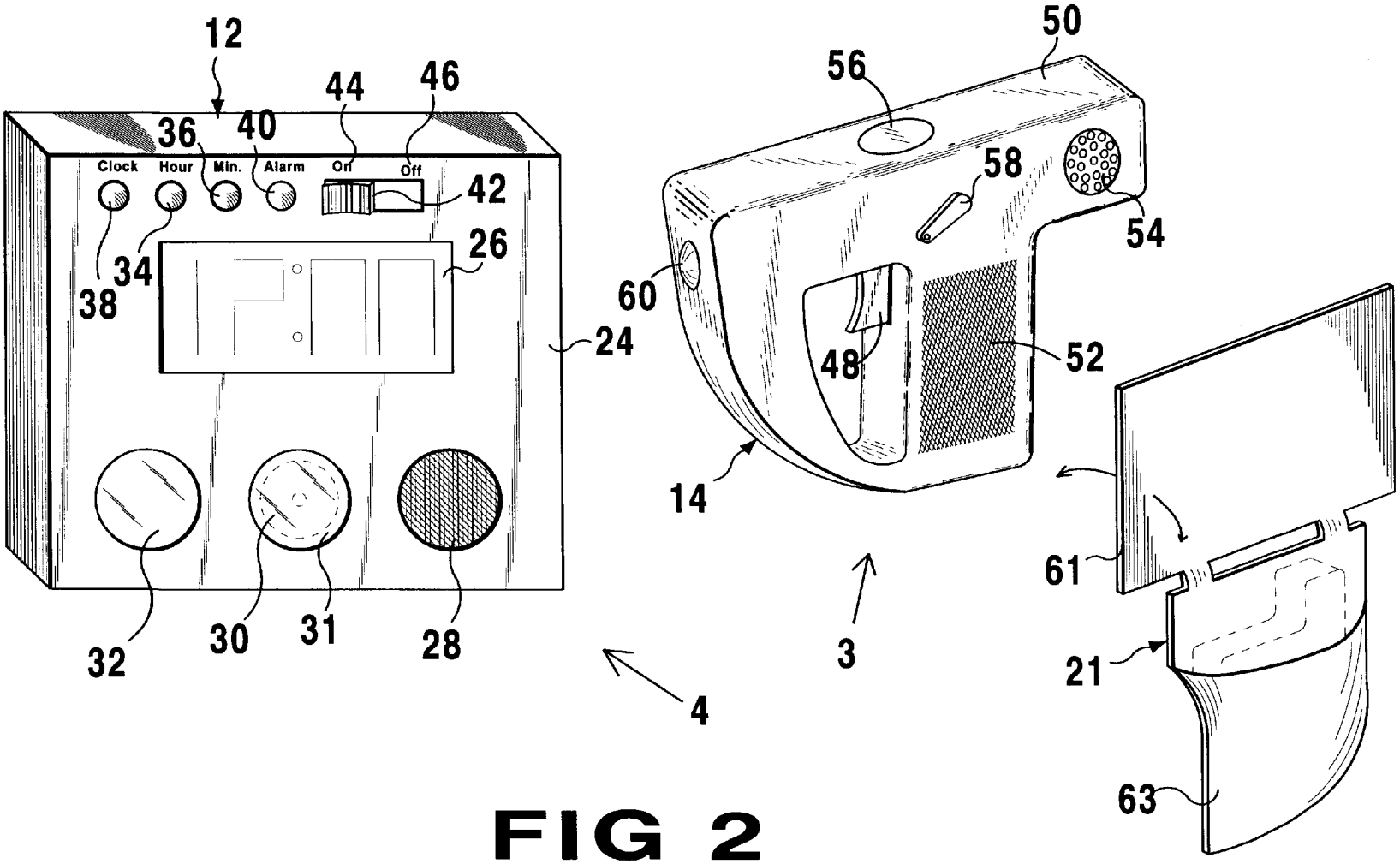
FIG. 2 is a front perspective view of the alarm clock and remote control unit of the remotely activated alarm clock system of the present invention.

An enlarged view of the remotely activated alarm clock system 10 of the present invention is illustrated in FIG. 2. The face side 24 of the alarm clock 12 is illustrated in this figure and depicts the controls found thereon. On the face side 24 is a time display 26 providing a visual indication of the time of day. The time display 26 is illustrated as a digital LED display. However, the time display 26 may be displayed as a conventional clock including an hour hand, minute hand and second hand. The time display 26 may also be in any other conventional form able to communicate the time of day to a user.

While a preferred mechanism for monitoring and displaying the time of day is shown and described herein, those of ordinary skill in the art who have read the description will appreciate that there are numerous other mechanisms for monitoring and displaying the time of day and, therefore, as used herein the phrase "means for monitoring and displaying the time" should be construed as including all such mechanisms as long as they achieve the desired result of monitoring and displaying the time, and, therefore, that all such equivalent mechanisms are to be considered as equivalents to the one described herein.

Also positioned on the face side 24 is the visual indicator 32. The visual indicator 32 provides a visual indication that an infrared signal has been received and the light 31 will illuminate when a set alarm activation time has arrived and the alarm clock 12 has been triggered to generate an alarm signal. The speaker 28 for producing an audible alarm signal when the alarm clock 12 has been triggered to generate an alarm signal is also positioned on the face side 24 of the alarm clock 12. The infrared receiver 30 is positioned on the face side 24 of the alarm clock 12 for receiving the transmitted infrared signal 22 and in response to receipt of the infrared signal 22 will activate the snooze control circuit as will be described hereinafter.

Also positioned on the face side 24 of the alarm clock 12 are a number of control buttons for setting the time of day and alarm. An hour button 34 is positioned on the face side 24 for setting the hour on the time display 26 and a minute button 36 is positioned adjacent thereto for setting the minutes of the time display 26. A clock button 38 activates the hour button 34 and minute button 36 for setting the time of day when pressed. An alarm button 40 activates the hour button 34 and minute button 36 for setting the alarm time when pressed. A switch 42 is also positioned on the face side 24 for placing the alarm in the active mode for generating an alarm signal upon determining the time of day is the same as the time to which the alarm is set.

The alarm switch 42 is illustrated as a two position switch having a first "ON" position 44 and a second "OFF" position 46. When in the first "ON" position 44, the alarm is in the active mode and will produce an alarm signal upon determining the time of day is the same as the time to which the alarm is set. When in the second "OFF" position 46, the alarm is in the inactive mode and will not produce an alarm signal upon determining the time of day is the same as the time to which the alarm is set. Alternatively, the alarm clock 12 may also include other features such as a radio (not shown) and in which case the alarm switch 42 will include additional positions such as for turning the radio on and selecting between turning the radio on or a standard alarm signal when it is determined the time of day is the same as the time to which the alarm is set.

The remote control unit 14 is preferably in the form of a laser gun however, any shape for the remote control unit 14 may be used. Use of a laser gun shaped remote control unit 14 is for purposes of example only and not meant to limit the scope of the present invention. Furthermore, the use of a laser gun shaped remote control unit 14 is for purposes of enjoyment for the user in activating the snooze control circuit of the alarm clock 12 while aiding the user in relieving stress caused by being awaken by the alarm clock 12. The laser gun shaped remote control unit 14 allows the user to simulate shooting the alarm clock 12 with a gun when it is activated.

The remote control unit 14 includes an activation button 48. In an embodiment of the remote control unit 14 as illustrated, the activation button 48 is in the form of a trigger on the laser gun. Pressing the activation button 48 causes the infrared signal 22 to be generated and transmitted in the direction in which a barrel 50 of the laser gun 14 is directed.

The laser gun 14 also includes a trigger guard, and a handle 52 for the user to grasp. Positioned on the laser gun 14 is a speaker 54 and a visual indicator 56. The speaker 54 and visual indicator 56 generate an audible and visual alarm mimicking the sounds of a laser gun thereby adding to the effect of shooting at the alarm clock 12. Also positioned on the laser gun 14 is an on/off switch 58 for activating the laser gun 14 and an infrared transmitter 60 for transmitting the infrared signal when the trigger 48 is pressed.

The holster 21 for retaining the remote control unit 14 therein when not in use is also illustrated in this figure. The holster 21 includes an attachment device 61 for connecting the holster 21 to an object adjacent the user, e.g. the bed 18 as illustrated in FIG. 1. The attachment device 61 illustrated is a flat rigid sheet for placement between the mattress and box spring of the bed 18. Extending from the attachment device 61 is a retaining portion 63 for receiving the remote control unit 14 therein.

While a preferred mechanism for attaching the holster to an object is shown and described herein, those of ordinary skill in the art who have read the description will appreciate that there are numerous other mechanisms for attaching the holster to an object and, therefore, as used herein the phrase "means for attaching the holster" should be construed as including all such mechanisms as long as they achieve the desired result of attaching the holster to an object, and, therefore, that all such equivalent mechanisms are to be considered as equivalents to the one described herein.

Figure 3:
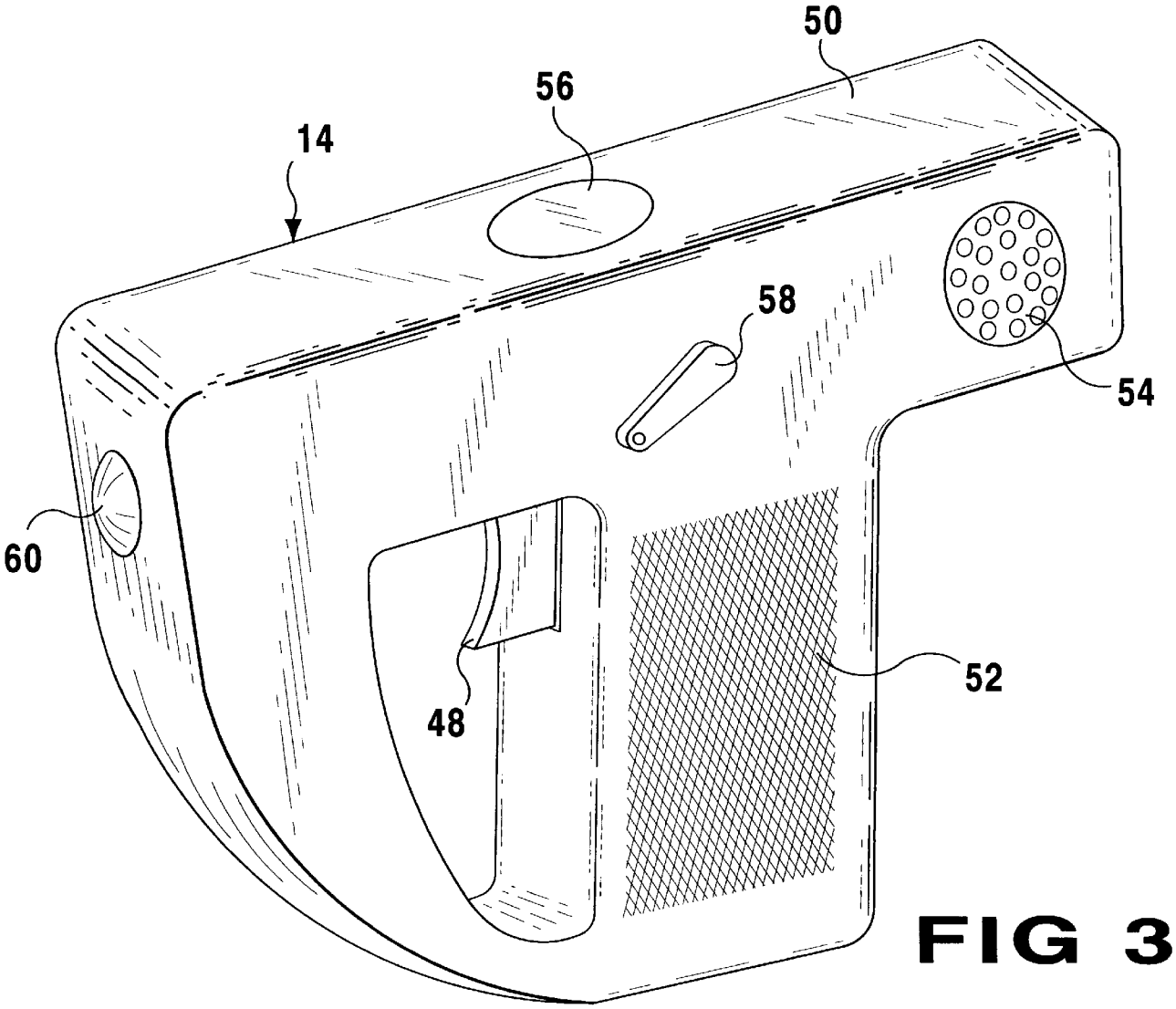
FIG. 3 is a top perspective view of the remote control unit used with the remotely activated alarm clock system of the present invention.

FIG. 3 illustrates an enlarged view of the remote control unit 14 shaped as a laser gun. The activation button 48 is in the form of a trigger on the laser gun and upon activation causes the infrared signal 22 to be generated and transmitted in the direction in which the barrel 50 of the laser gun 14 is directed. In the figure as illustrated the infrared signal 22 would be transmitted in a direction into the paper. The laser gun 14 includes a trigger guard and the handle 52 for grasping by the user when preparing to aim the laser gun 14 towards the alarm clock 12 and press the trigger 48. The speaker 54 and visual indicator 56 are positioned on the outside of the laser gun and generate audible and visual alarm signals mimicking the sights and sounds of a laser gun when the trigger 48 is pressed and the infrared signal transmitted. The producing of the audible and visual alarm signals enhance the effect of shooting at the alarm clock 12. Also positioned on the laser gun 14 is the on/off switch 58 for activating the remote control unit 14 and the infrared transmitter 60 for transmitting the infrared signal 22 to the alarm clock 12.

Figure 4:
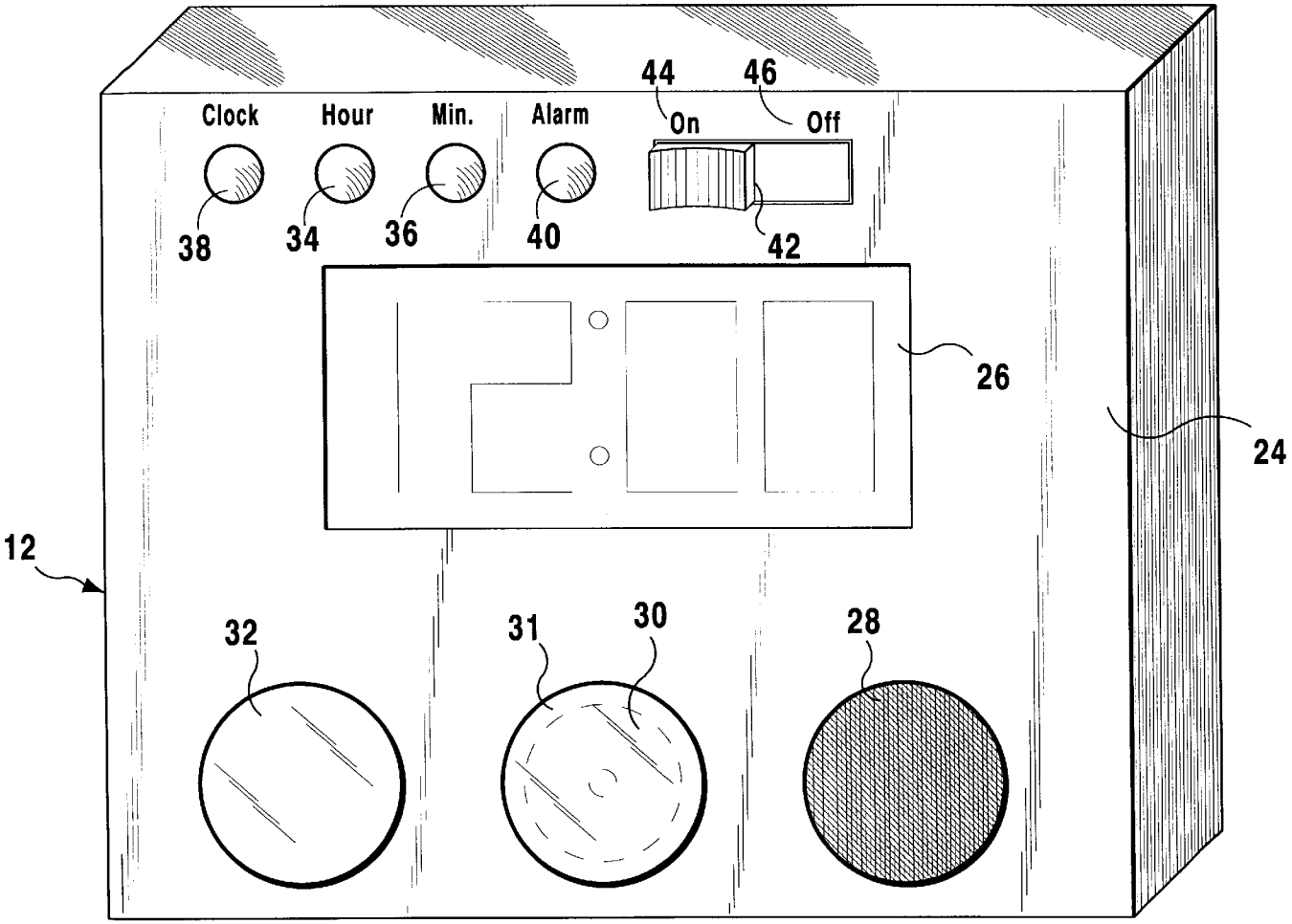
FIG. 4 is a front perspective view of the alarm clock used with the remotely activated alarm clock system of the present invention.

FIG. 4 illustrates an enlarged perspective view of the alarm clock 12. The alarm clock 12 includes the time display 26 positioned on the face side 24 thereof for notifying the user of the present time and for use in informing the user as to the set alarm activation time. The visual indicator 32 is also positioned on the face side 24 and provides a visual indication that an infrared signal has been received. The light 31 illuminates when the alarm clock determines that the set alarm time matches the current time thereby aiding the user in visualizing the alarm clock 12. The speaker 28 which produces the audible alarm signal when the alarm clock 12 has been triggered to generate an alarm signal is also positioned on positioned on the face side 24 of the alarm clock 16. The infrared receiver 30 is positioned on the face side 24 of the alarm clock 16 for receiving the transmitted infrared signal 22 and in response to receipt of the infrared signal 22 causes the visual alarm 32 to illuminate and the snooze control circuit to be activated as will be described hereinafter.

Positioned on the face side 24 of the alarm clock 12 are the control buttons for setting the time of day and alarm set time. The hour button 34 is positioned on the face side 24 for setting the hour on the time display 26 and a minute button 36 is positioned adjacent thereto for setting the minutes of the time display 26. The clock button 38 activates the hour button 34 and minute button 36 for setting the time of day when pressed. The alarm button 40 activates the hour button 34 and minute button 36 for setting the alarm time when pressed. The slide switch 42 is also positioned on the face side 24 for switching the alarm between the active and inactive modes. In the active mode, the alarm clock 12 will generate the alarm signal upon determining the time of day is the same as the time to which the alarm is set. When in the inactive mode, the alarm clock 12 will not generate an alarm signal.

The alarm switch 42 is illustrated as being operable between the first "ON " position 44 and second "OFF" position 46. When in the first "ON" position 44 the alarm clock 12 is in the active mode and will produce the alarm signal upon determining the time of day is the same as the time to which the alarm is set. When in the second "OFF" position 46 the alarm is in the inactive mode and will not produce an alarm signal. Alternatively, the alarm clock 12 may also include other features such as a radio (not shown) and in which case the alarm switch 42 will include additional positions such as for turning the radio on and selecting between turning the radio on or a standard alarm signal when it is determined the time of day is the same as the time to which the alarm is set.

Figure 5:
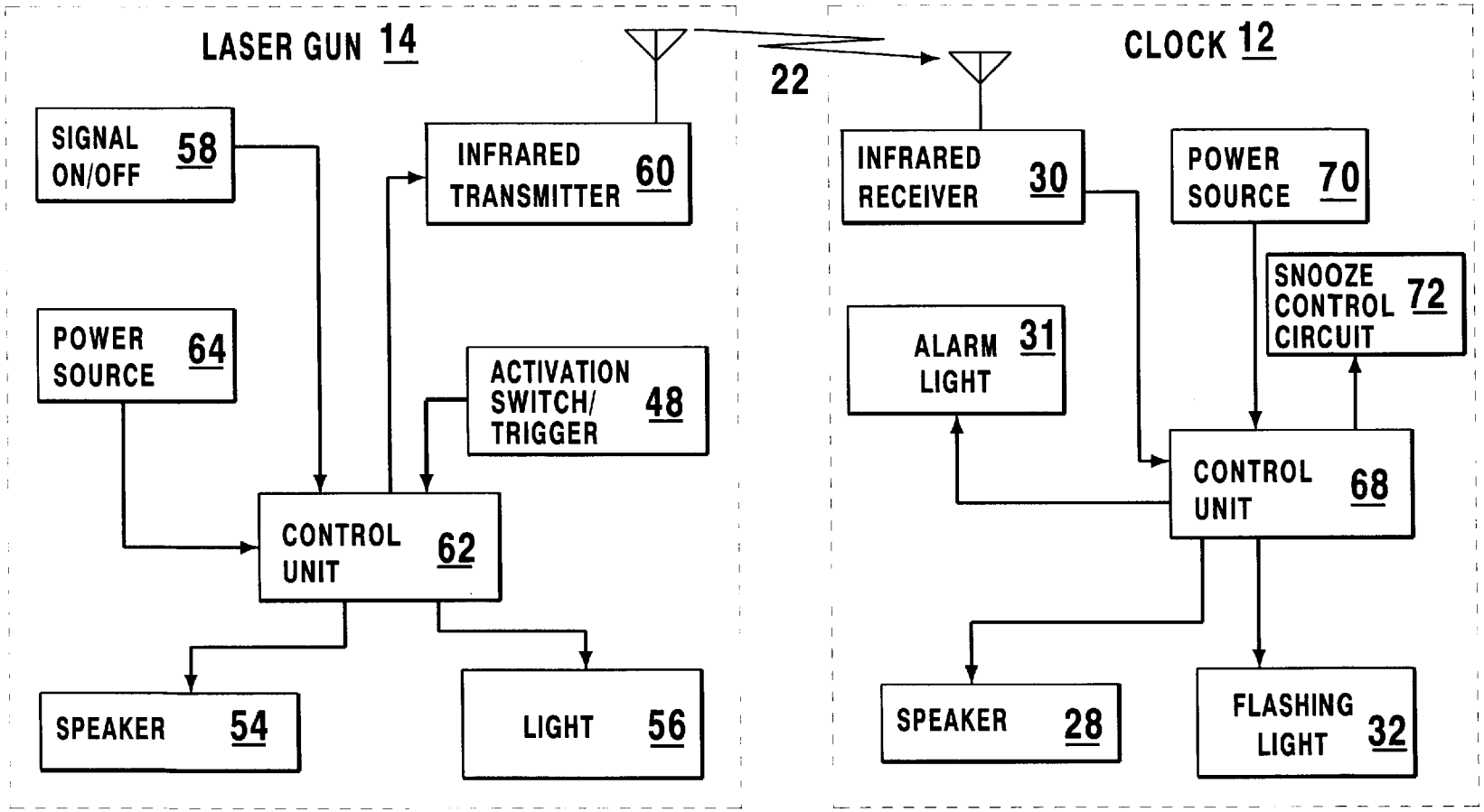
FIG. 5 is a block diagram illustrating the internal components of the remotely activated alarm clock system of the present invention.

A block diagram illustrating the internal components and their interconnections within the remotely activated alarm clock system 10 is shown by FIG. 5. As can be seen from this figure, the remote control unit 14 includes a control unit 62 which receives power from an internal power source 64 such as a battery or even a solar panel and distributes power to the other components within the remote control unit 14. The activation switch/trigger 48 is connected to the control unit 62 for activating the control unit 62 to generate the infrared signal 22. The control unit 62 is also connected to an infrared transmitter 60 for transmitting the infrared signal 22 towards the alarm clock 12. The control unit 62 is also connected to activate the speaker 54 and visual indicator light 56 to produce the audible and visual signals mimicking that of a laser gun and enhancing the effect of using the remotely activated alarm clock system 10. The on/off switch 58 is connected between the power source 64 and the control unit 62 for providing a connection between the power source and the control unit62 when activated. Upon activation, the on/off switch 58 also produces a clicking sound to indicate the remote control unit 14 has been activated.

The alarm clock 12 also includes a control unit 68 connected to receive power from a power source 70 and distribute power to the other components within the alarm clock 12. The infrared receiver 30 is connected to the control unit 68 and upon receipt of the infrared signal 22 from the remote control unit 14 signals the control unit 68 to activate the snooze control circuit 72. Upon receiving the signal from the infrared receiver 30, the control unit also activates the speaker 28 and flashing light 32 to generate the alarm signal mimicking the sights and sounds which would occur if shot by a laser gun. The light 31 surrounding the infrared receiver is also caused to be illuminated when the infrared signal is received and the alarm clock 12 determines that the set alarm activation time has arrived and the alarm clock 12 has been triggered to generate an alarm signal.

Figures 6, 6A, 6B:
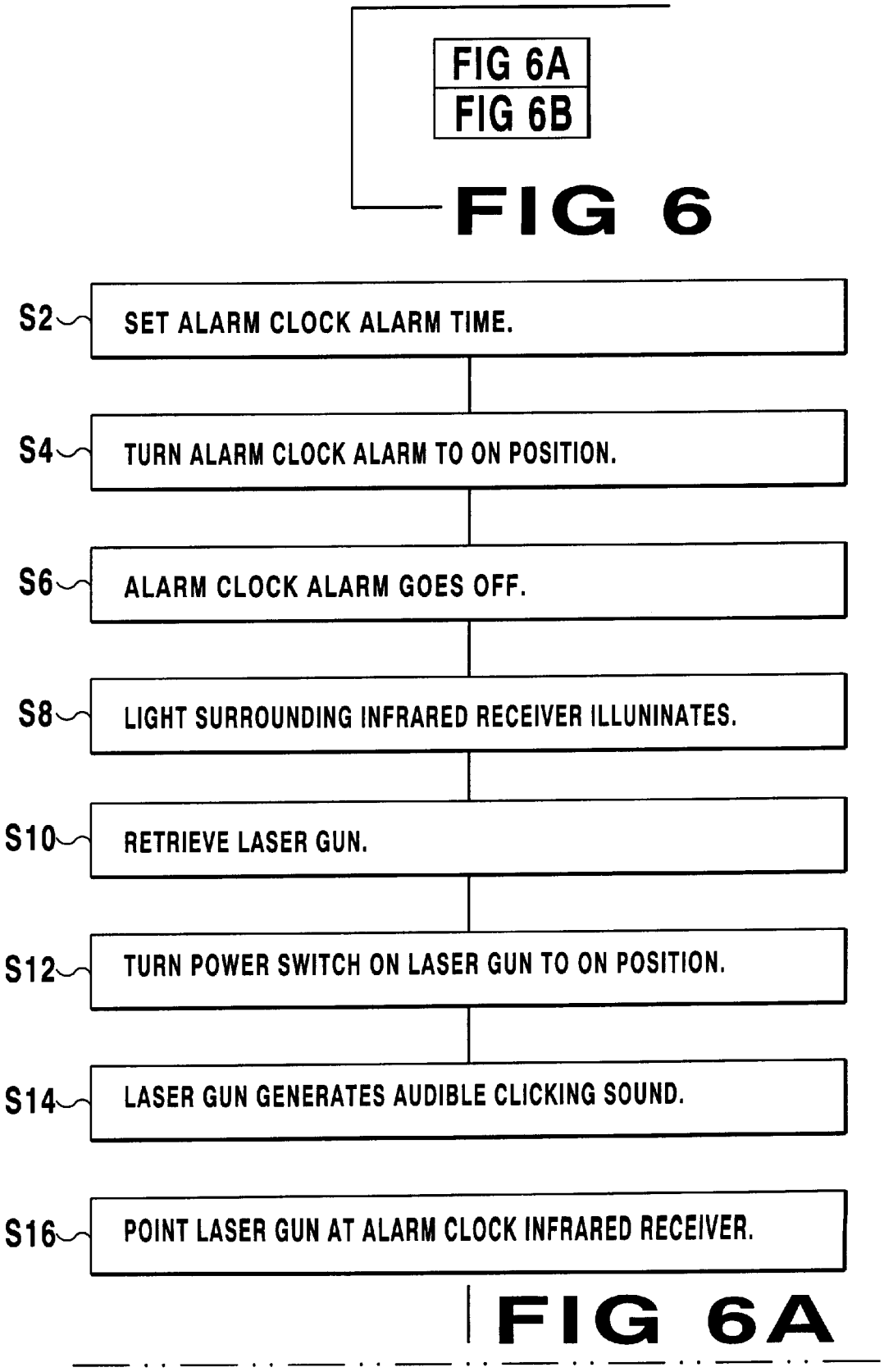
FIG. 6 is a flow diagram illustrating the use of the remotely activated alarm clock system of the present invention.
Figure 6B:
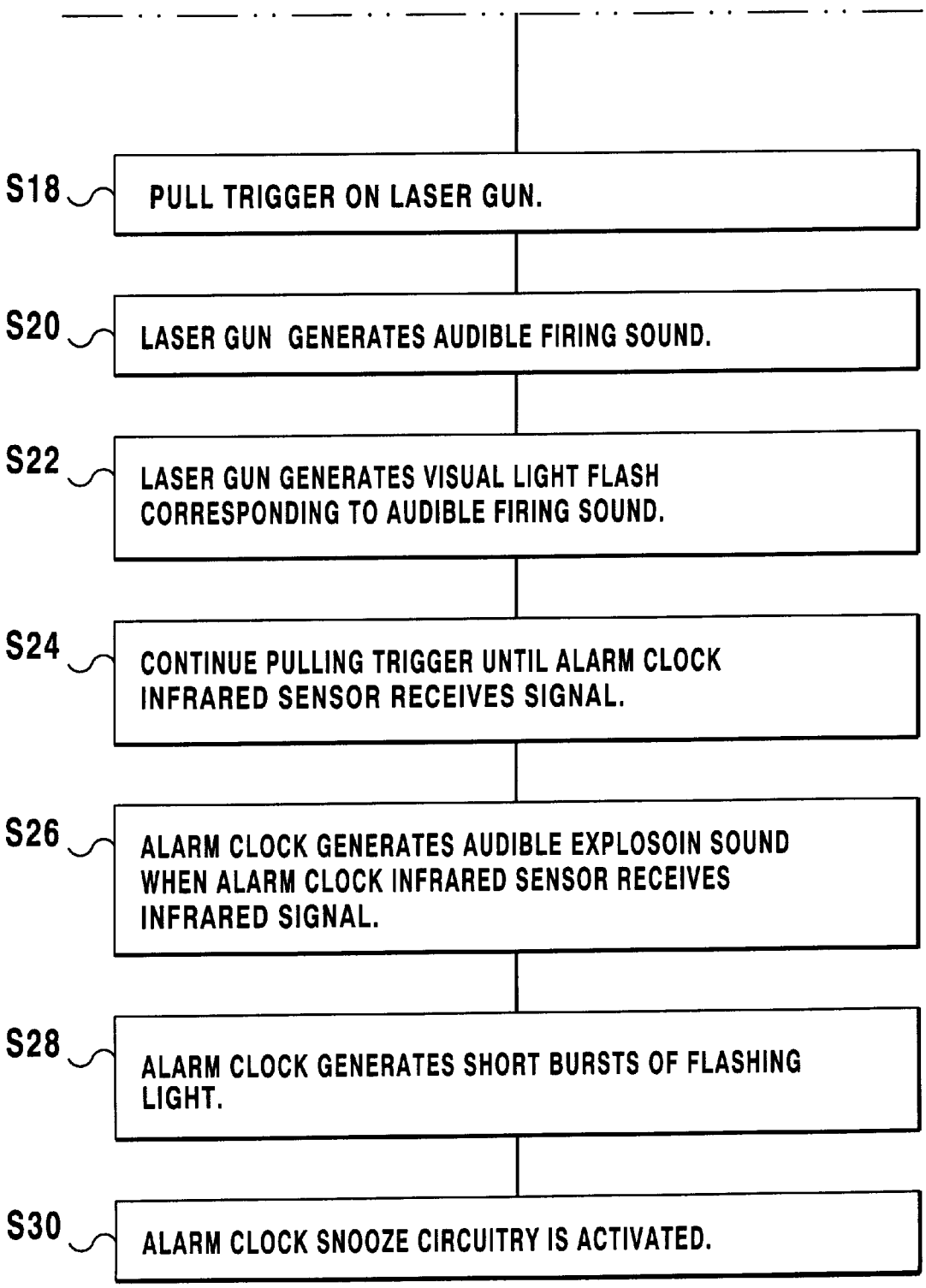

The operation of the alarm clock and remote control unit 10 will now be described with reference to the figures and specifically FIG. 6. In operation, the alarm clock and remote control unit 10 is positioned as desired within a room. The alarm clock need only be in a location visible to the user but need not be within the immediate reach of the user. When it is desired to use the alarm clock, the alarm time is set by pressing the alarm button and adjusting the hour button and minute button to read the desired alarm time as described in step S2. The alarm switch is then placed in the ON position to set the alarm as stated in step S4. The alarm is now set and the user may go about his business secure that the alarm will sound at the set time.

When it is determined by the control unit of the alarm clock that the present time matches the set alarm time the alarm is activated to notify the user of the time and a light surrounding the infrared receiver on the alarm clock is illuminated and thus can be readily seen by the user as discussed in steps S6 and S8. If the user has been sleeping and wishes to turn the alarm off for a predetermined period of time by activating the snooze control circuit, the laser gun remote control unit is retrieved and turned on by activating the on/off switch, this causes the laser gun to generate an audible clicking sound as stated in steps S10, S12 and S14. The laser gun is then pointed at the alarm clock and the trigger is pulled as stated in steps S16 and S18. In response to pulling of the trigger, the laser gun will generate an audible firing sound emanating from the speaker accompanied by shorts bursts of light produced by the visual indicator as stated in steps S20 and S22. The laser gun remote control unit also generates the infrared beam which is transmitted to the alarm clock. The trigger on the laser gun is continually pressed until it is determined that the infrared signal has been received by the alarm clock as stated in step S24.

Upon receipt of the infrared signal by the infrared receiver of the alarm clock, the control unit of the alarm clock controls the speaker and visual indicator on the face side of the alarm clock to simulate a sound resembling an explosion and generate short bursts of light as described in steps S26 and S28. The control unit of the alarm clock then activates the snooze control circuit to turn off the alarm for the predetermined period of time as discussed in step S30. At the expiration of the predetermined time, the alarm will be produced again and the user can either reactivate the laser gun to turn on the snooze control circuit or get up and turn off the alarm.

From the above description it can be seen that the alarm clock and remote control unit of the present invention is able to overcome the shortcomings of prior art devices by providing an alarm clock and remote control unit which is able to activate a snooze alarm circuit of an alarm clock from a position remote from the alarm clock. The remote control unit of the alarm clock and remote control unit is in the form of a laser gun which is able to produce additional visual and audible effects consistent with the firing of the laser gun when activating a remote control unit to generate the infrared signal, the infrared signal being emitted upon activation of a trigger on the laser gun shaped remote control unit. The alarm clock of the alarm clock and remote control unit is also able to produce additional visual and audible effects upon receipt of the infrared signal and includes an additional visual for providing a visible signal for a predetermined period of time that the infrared signal has been received. Furthermore, the alarm clock and remote control unit of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claim:

1. An alarm clock having a remotely activated snooze control circuit for enabling a snooze alarm from a position remote from the circuit comprising:

a) a remote control unit in the form of a T-shaped laser gun having a trigger switch with a trigger guard and including an infrared signal generator and a transmitter, and means comprising a speaker unit mounted on said laser gun for producing an audible signal simulating the firing of a laser gun and a visual indicator for producing a visual alarm upon generation of said infrared signal by closing of said trigger switch;

b) said alarm clock including an infrared receiver with a light surrounding said infrared receiver and a control unit connected to both said infrared receiver and the snooze control circuit for activating the snooze control circuit upon receipt by said infrared receiver of said infrared signal transmitted by said infrared transmitter so that firing of said remote control unit in the direction of said alarm clock will activate said infrared receiver;

c) said alarm clock including means for setting an alarm time and a switch for operating said alarm clock between a first mode wherein an alarm signal will be generated upon a determination of said control unit that a present time matches an alarm set by said means for setting and a second mode in which an alarm signal is not generated;

d) said alarm clock further comprising a speaker connected to said control unit for producing an audible signal simulating the sound of an explosion upon receipt of said infrared signal and a visual alarm generator connected to said control unit for producing a visual alarm signal in an alarm light upon receipt of said infrared signal, and wherein activation of the snooze control circuit ceases generation of an alarm signal by said alarm clock for a predetermined period of time after which the alarm signal is again generated, and wherein a numeric display, said infrared receiver with said light surrounding said infrared receiver, said speaker, said means for setting said clock and alarm, and said alarm light being located on a front face of said alarm clock; and (e) a holster conveniently mounted adjacent said user for storing said remote unit in a manner similar to that of a hand gun.

* * * * *